US005269525A

United States Patent [19]

Hull et al.

[11] Patent Number: 5,269,525

[45] Date of Patent: Dec. 14, 1993

[54] COMBINATION GOLF PUTTER, RETRIEVER AND EJECTION MEANS

[76] Inventors: Harold L. Hull, 401 Canyon Way #43, Sparks, Nev. 89434; Pete Rasner, P.O. Box 2607, Carson City, Nev. 89702

[21] Appl. No.: 948,003

[22] Filed: Sep. 21, 1992

[51] Int. Cl.[5] ..... A63B 53/04

[52] U.S. Cl. ..... 273/162 E

[58] Field of Search ..... 273/162 E, 32 F, 162 D, 273/162 F, 162 C, 162 R

[56] References Cited

U.S. PATENT DOCUMENTS

| | | | |
|---|---|---|---|
| 3,300,241 | 1/1967 | Eberwein et al. | 273/162 E X |
| 3,374,027 | 3/1968 | Jacobs | 273/162 E X |
| 3,749,407 | 7/1973 | Prochnow | 273/162 E |
| 3,779,398 | 12/1973 | Hunter | 273/183 D |
| 4,486,019 | 12/1984 | Sievers | 273/162 E |
| 4,515,402 | 5/1985 | Sedan | 294/19.2 |
| 4,580,784 | 4/1986 | Brill | 273/162 E |
| 4,728,134 | 3/1988 | Allen | 294/19.2 |
| 4,976,436 | 12/1990 | Serizawa | 273/162 E |

*Primary Examiner*—George J. Marlo

[57] ABSTRACT

Disclosed is a combination golf ball putter and ball retriever having a conventional handle and hand grip and a golf club head with a striking surface and a flat bottom surface at right angles to the striking surface, with the bottom surface having a circular recess in its center section of the size and shape to receive and frictionally engage a golf ball and having golf ball ejecting device including two connected members having enlarged heads at their opposite ends and slidable within a vertical bore having end recesses to accommodate said heads.

1 Claim, 2 Drawing Sheets

COMBINATION GOLF PUTTER, RETRIEVER AND EJECTION MEANS

FIELD OF THE INVENTION

This invention relates to golf ball retrievers or the like but more particularly to a combination golf putter and retriever including an ejection means.

BACKGROUND OF THE INVENTION

In the past several attempts have been made to provide a golf club which includes means to retrieve a golf ball, such as U.S. Pat. No. 4,580,784 wherein they teach a golf club having the side sections of the head being provided with spaced, parallel, gripping edges which define a recess in the sole of the head for scooping up a golf ball. U.S. Pat. No. 4,486,019 teaches a golf putter and retriever which provides a striking surface on one side of the head and on the opposite side a cup-shaped depression so as to allow a golf ball to be lifted. U.S. Pat. No. 3,779,398 provides a golf putter with its retrieval means being a semi-circular recess located on the top side of the head which enables a golf ball to be scooped into the recess for retrieval. U.S. Pat. Nos. 4,728,134, 4,515,402 and 3,749,407 all teach retrieval devices, however they are complicated and cumbersome and they do not fulfill the needs of todays golfers as does the present invention.

The present invention, due to its unique design, provides a combination golf putter and retriever which is exceptionally easy to use especially when retrieval of a golf ball from a cup is desired. One inherent problem with the prior art includes difficulty when retrieving the ball from a cup, as these references tend to cause damage to the cup from trying to scoop up the ball or they are so designed that the angle at which the club handle must be held, causes difficulty when trying to align the ball and retrieval means. Yet another inherent problem involves difficulty when release of the ball is desired, in most cases the golf ball is frictionally engaged, therefore, the user must grasp the ball with their fingers. The present invention addresses this problem in a second embodiment, by providing an ejection means which simply releases the ball and can be operated in two ways, either by placing the users foot on top of the ejection means so that bending over is not necessary, or by finger actuation.

Therefore it is a primary object of the present invention to provide a golf putter and retriever which can easily be used to remove a golf ball from a cup or other irregular surface.

Another object is to provide a putter and retriever which can be used without unnecessary bending or stooping.

Still a further object is to provide the putter and ball retriever with an ejection means for removal of the ball and can be foot or finger actuated.

Yet another object is to provide a golf putter and retriever which overcomes the inherent problems incurred with the prior art.

Another object is to provide a striking surface on one side of the golf head and a circular recess on its bottom side for frictional engagement with a golf ball.

Other objects and advantage will become apparent when taken into consideration with the following drawings and specifications.

DETAILED DESCRIPTION OF THE DRAWINGS

Figure 2:
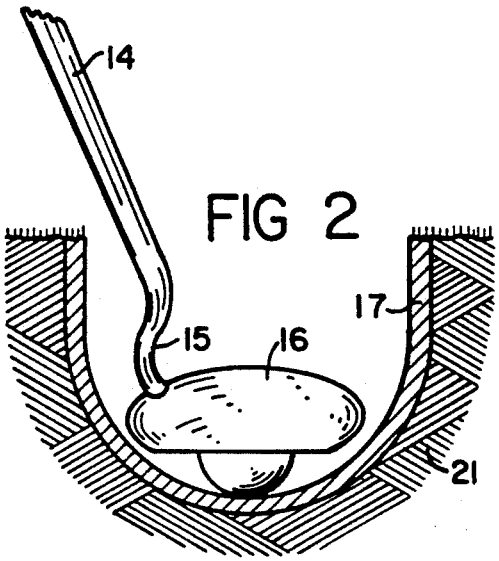
FIG. 2 is a side view of the device shown inserted into a golf cup while cooperating with a golf ball.
Figure 1:
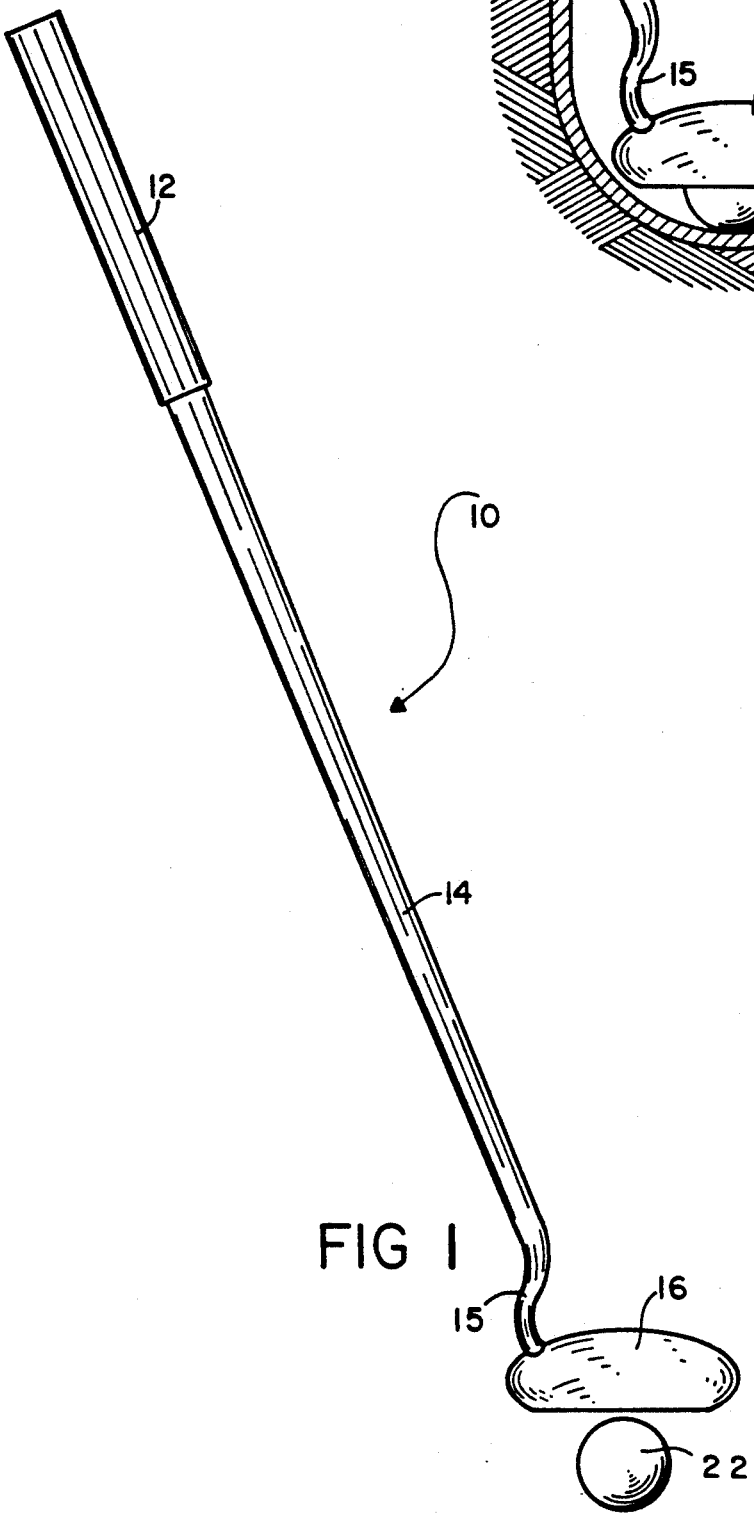
FIG. 1 is a side view of the device shown as the preferred embodiment.
Figure 3:
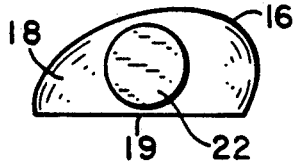
FIG. 3 is a bottom view of the device showing its circular recess for frictional engagement with a golf ball.

Referring now in detail to the drawings wherein like characters refer to like elements throughout the various drawings, in FIG. 1, 10 is an overview of the golf putter and ball retriever while 12 is a protective hand grip attached by suitable means to the distal end of an elongated, cylindrical, tapered handle 14, handle 14 having substantially a 30 degree curvature 15 on its opposite end so as to allow for easy insertion into a golf cup 17 within sod 21, with the handle being suitably attached to a golf club head 16, head 16 being substantially oval-shaped with a flat bottom surface 18 having a circular recess substantially in its center section, head 16 having a flat, vertical striking surface 19 for striking a golf ball 22. In FIGS. 4–7, a second embodiment includes the golf club head 16 having a bore 24, bore 24 having a first and second recessed end, i.e. 32 and 34, bore 24 receives and accepts a first member 28, and a second member 30, each having threads 32 for mating therewith. When first member 28 is inserted through bore 24, and second member 30 is inserted through the distal end of bore 24, members 28 and 30 can be threadably engaged, when member 28 and 30 are threadably engaged they provide ejection means 26, whereby providing a slidable relationship with bore 24.

Figure 5:
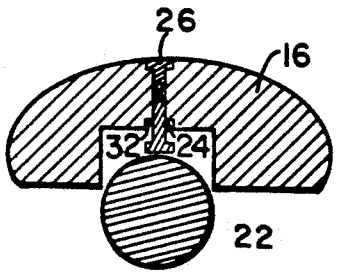
FIG. 5 is a sectional view taken at 5—5 of FIG. 4 shown with the ejection means in its second position while cooperating with a golf ball.
Figure 6:
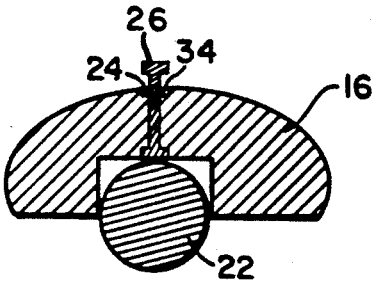
FIG. 6 is a sectional view taken at 5—5 of FIG. 4 shown with the ejection means in its first position while cooperating with a golf ball.
Figure 4:
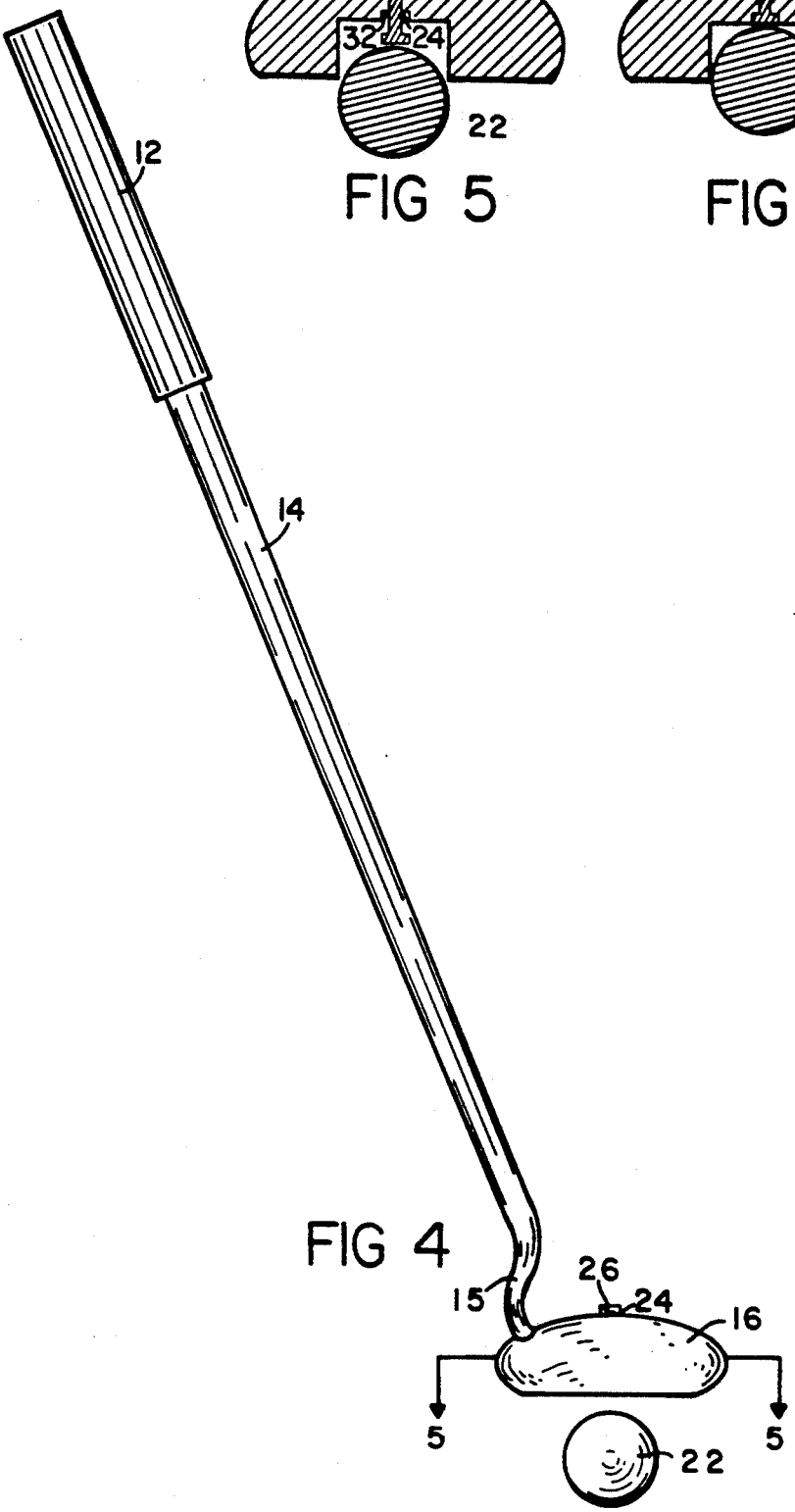
FIG. 4 is a side view of the device showing a second embodiment having an ejection means.
Figure 7:
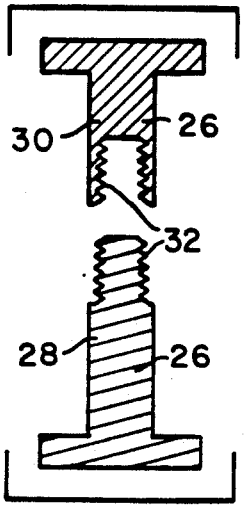
FIG. 7 is a blown-up side view of the ejection means.

When the golf club head 16, is placed above the golf ball 22 and pressed down, the circular recess receives accepts and frictionally engages substantially half of ball 22, and ejection means 26 is pushed up into the golf club head 16 to a first position as shown in FIG. 6, and is received by first recessed end 32, thereby allowing the user to pick up golf ball 22. When the user wishes to release ball 22, the user simply pushes down on ejection means 26 with either their hand or foot, thereby ejection means 26 is now in its second position as shown in FIG. 5, received by second recessed end 34, ejection means 26 expels golf ball 22 causing release of golf ball 22.

It will now be seen that we have provided a golf putter, ball retriever and ejection means which can be easily used to remove a golf ball from a cup or other irregular surface.

It will also be seen that we have provided a golf putter and ball retriever which can be used without unnecessary bending or stooping.

It will be further seen that we have provided a golf putter, ball retriever and ejection means for removal of the ball and can be foot or finger actuated.

It will also be seen that we have provided a golf putter and ball retriever and ejection means which ovedrcomes the inherent problems incurred with the prior art.

It will be seen that we have also provided a golf putter and ball retriever and ejection means which provides a striking surface on one side of the golf head and a circular recess on its bottom side for frictional engagement with a golf ball.

Although the invention as been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described our invention, what we claim as new and desire to secure by letters patent is:

1. A combination golf putter and ball retriever device comprising; a handle, a hand grip, said handle having means to attach said hand grip to one of its ends, a golf club head, means to attach said golf club head to the opposite end of said handle, said head having a golf ball striking surface, said head having a flat bottom surface substantially at a right angle to said striking surface, said bottom surface having a circular recess substantially in its center section, said recess being of a size and shape to receive, accept and frictionally engage a golf ball, said head having a vertical bore substantially in its center section, a first and second member, said bore being of a size and shape to receive and accept said first and second members, said bore having first and second recessed ends, said first and second members being interlockingly engaged on one of their ends, said first and second members having a head on their distal ends, said last named heads being of a size and shape to cooperate with said recessed ends of said bore, said first and second members when threadably engaged being longer than said bore, said members when threadably engaged having a first and second position, said threadably engaged members having a sliding relationship with said bore, whereby, when said threadably engaged members are in said first position, one of said heads of said members is received by one of said recessed ends of said bore, and when said threadably engaged members are in said second position, the opposite head of said member is received by the opposite said recessed end of said bore.

* * * * *